US007326888B2

(12) United States Patent
Chun et al.

(10) Patent No.: US 7,326,888 B2
(45) Date of Patent: Feb. 5, 2008

(54) COOKING APPARATUS, COOKING SYSTEM AND COOKING CONTROL METHOD USING THE SAME

(75) Inventors: Yun Bong Chun, Yongin-Si (KR); Kwang Keun Kim, Yongin-Si (KR); Sook Young Ji, Suwon-Si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 11/366,627

(22) Filed: Mar. 3, 2006

(65) Prior Publication Data

US 2007/0029306 A1 Feb. 8, 2007

(30) Foreign Application Priority Data

Jul. 20, 2005 (KR) ..... 10-2005-0065886

(51) Int. Cl.
*H05B 1/02* (2006.01)

(52) U.S. Cl. ..... 219/506; 219/497; 219/412; 219/708; 219/715; 99/325

(58) Field of Classification Search ..... 219/494, 219/497, 501, 506, 412–414, 708, 714; 99/325–331
See application file for complete search history.

(56) References Cited

U.S. PATENT DOCUMENTS 5,183,984 A * 2/1993 Nakagawa ..... 219/720
5,361,681 A * 11/1994 Hedstrom et al. ..... 99/331
2002/0027164 A1* 3/2002 Mault et al. ..... 235/462.46
2006/0178947 A1* 8/2006 Zsigmond et al. ..... 705/26

FOREIGN PATENT DOCUMENTS

KR 1999-0035655 5/1999
KR 1020000039122 A 7/2000

* cited by examiner

*Primary Examiner*—Mark Paschall
(74) *Attorney, Agent, or Firm*—Staas & Halsey LLP

(57) ABSTRACT

Disclosed herein is a cooking apparatus and cooking system which allows a user to change cooking information that is suitable to the preferences of the user and the amount of food when cooking food using automatic cooking information, and a cooking control method using the same. The cooking apparatus using automatic cooking information includes an automatic cooking information acquisition unit for acquiring the automatic cooking information; an automatic cooking information change unit for allowing a user to change the acquired automatic cooking information; and a control unit for controlling a series of cooking operations on the basis of the changed cooking information. The cooking system that uses automatic cooking information includes an external terminal for acquiring the automatic cooking information and transmitting the automatic cooking information to a cooking apparatus; an automatic cooking information change unit for allowing a user to change the transmitted automatic cooking information; and a control unit for controlling a series of cooking operations on the basis of the changed cooking information.

5 Claims, 8 Drawing Sheets

COOKING APPARATUS, COOKING SYSTEM AND COOKING CONTROL METHOD USING THE SAME

CROSS-REFERENCE TO RELATED APPLICATIONS

This application claims the benefit of Korean Patent Application No. 2005-65886, filed on Jul. 20, 2005 in the Korean Intellectual Property Office, the disclosure of which is incorporated herein by reference.

BACKGROUND OF THE INVENTION

1. Field of the Invention

The invention relates to a cooking apparatus for reading cooking information from a bar code and, more particularly, to a cooking apparatus and cooking system which allows a user to change cooking information based on the preferences of the user and the amount of food used during cooking food using automatic cooking information, and a cooking control method using the same.

2. Description of the Related Art

A general cooking apparatus uses a variety of heat sources to cook food. According to the heat sources, there are a variety of different products on the market. Among them, an electronic oven (also called a "microwave oven") applies a high voltage to a magnetron, a high frequency oscillating tube, which generates microwaves at about 2450 MHz. The electronic oven causes the microwave to vibrate water molecules contained in food, and rapidly heats food using frictional heat generated by the vibration of water molecules.

In the case where the electronic oven is used to cook food, it usually allows a user to manually input cooking information such as cooking time, cooking temperature and a power level, through a key input unit mounted on the front panel of the electronic oven in the state of previously knowing food information well. However, this conventional electronic oven requires the user to manually input the cooking information.

Although food is designed to be conveniently cooked using the electronic oven, the variety of foods has increased recently, and the above method for manually inputting the cooking information is difficult and inconvenient to set suitable cooking conditions.

A bar code reading electronic oven has been developed to overcome this problem, which includes a bar code reader for scanning a bar code attached to the food package, and for reading cooking information such as cooking temperature, cooking time, a power level, etc. The bar code reading electronic oven cooks the food according to the cooking information acquired by the bar code reader. Hereinafter, the bar code reading electronic oven will be referred to as a cooking apparatus.

However, since the cooking apparatus scans the bar code attached to the food package using the bar code reader, reads the cooking information, and automatically cooks the food on the basis of the cooking information, the user cannot change a cooking state into a desired cooking state suitable to a preference of the user. Therefore, the user cannot satisfy the cooking state since the food is cooked in the state unsuitable to the preference of the user.

Therefore, since the user can not change some items (cooking temperature, cooking time or a power level) among overall cooking items of the cooking information and can not correct the cooking information, even when the user wants to change only a part of cooking items, it is difficult and inconvenient for the user to manually input overall cooking items (cooking temperature, cooking time, a power level, etc.) of the cooking information.

In addition, since the bar code attached to the food package provides cooking information with respect to the amount of food, when cooking a part of the food (for example, when cooking a smaller amount of food, or when cooking leftover food), the cooking apparatus can not utilize the cooking information acquired from the bar code, and it also requires the user to manually input overall cooking items.

SUMMARY OF THE INVENTION

It is an aspect of the invention to provide a cooking apparatus, where, by arranging a mode in which a user can change cooking information acquired through a bar code, when cooking food using automatic cooking information, the user can change the cooking information suitable to the preferences of the user or the amount of the food, and a control method using the same.

It is another aspect of the invention to provide a cooking system, where it is possible to send cooking information to a cooking apparatus using a terminal capable of accessing web servers, and a control method using the same.

It is yet another aspect of the invention to provide a cooking system, where it is possible to send cooking information of a bar code type using a terminal capable of accessing web servers, and a control method using the same.

Additional aspects and/or advantages of the invention will be set forth in part in the description which follows and, in part, will be obvious from the description, or may be learned by practice of the invention.

In accordance with embodiments of the invention, the above and/or other aspects can be achieved by the provision of an apparatus for cooking food using automatic cooking information, the apparatus including: an automatic cooking information acquisition unit for acquiring the automatic cooking information; an automatic cooking information change unit for allowing a user to change the acquired automatic cooking information; and a control unit for controlling a series of cooking operations on the basis of the changed cooking information.

The automatic cooking information acquisition unit may include a bar code reader for reading the automatic cooking information from a bar code.

The automatic cooking information acquisition unit may include a camera for capturing an image of the food; and a memory for storing a plurality of food images and the cooking information for corresponding foods, wherein the automatic cooking information acquisition unit compares the captured food image with the food images stored in the memory, determines an identification number (ID) of the food, and acquires the automatic cooking information corresponding to the ID of the food.

The apparatus may further include a display unit for displaying the acquired automatic cooking information, where the automatic cooking information change unit may further include a button for selecting the desired cooking item among cooking items displayed on the display unit.

The apparatus may further include a bar code output unit for outputting the changed cooking information of a bar code type.

In accordance with another aspect of the invention, there is provided a system for cooking food using automatic cooking information, the system including: an external terminal for acquiring the automatic cooking information and transmitting the automatic cooking information to a cooking apparatus; an automatic cooking information change unit for allowing a user to change the transmitted automatic cooking information; and a cooking apparatus including a control unit for controlling a series of cooking operations on the basis of the changed cooking information.

The external terminal may include a bar code reader for reading the automatic cooking information from a bar code.

The external terminal may include a camera for capturing an image of the food; and a memory for storing a plurality of food images and cooking information for corresponding foods, wherein the automatic cooking information acquisition unit compares the captured food image with the food images stored in the memory, determines an identification number (ID) of the food, and acquires the automatic cooking information corresponding to the ID of the food.

The external terminal may be any one of a PC, PDA, web pad and wireless telephone, and the external terminal may access a website/internet and acquire the automatic cooking information.

The external terminal and the cooking apparatus may further include a communication module for transmitting the automatic cooking information via wired or wireless communication.

In accordance with yet another aspect of the invention, provided is a system for cooking food using automatic cooking information, the system including: an external terminal for acquiring the automatic cooking information, changing the acquired automatic cooking information, and transmitting the changed automatic cooking information to a cooking apparatus; and a cooking apparatus including a control unit for controlling a series of cooking operations on the basis of the changed cooking information.

The external terminal may be any one of a PC, a PDA, a web pad and a wireless telephone, and the external terminal may access a memory of the cooking apparatus or a website/internet, acquire the automatic cooking information, and change the acquired automatic cooking information.

The external terminal and the cooking apparatus may further include a communication module for transmitting the changed automatic cooking information via wired or wireless communication.

The cooking apparatus may include a bar code reader, and the cooking system may include a bar code output unit for receiving the changed automatic cooking information from the external terminal, and for outputting the received automatic cooking information of a bar code type.

In accordance with yet another aspect of the invention, a control method of a cooking apparatus which cooks food using automatic cooking information, the control method including: acquiring the automatic cooking information; changing a part of cooking conditions among the acquired automatic cooking information; and cooking food on the basis of the changed cooking information.

The acquiring of the automatic cooking information may include any one of: acquiring the automatic cooking information from a bar code by means of a bar code reader; and capturing a food image, comparing the captured food image with a stored food image in a memory of the cooking apparatus, determining the identification number (ID) of the food, and acquiring the automatic cooking information with respect to the corresponding food.

The changing of the cooking conditions may include displaying the acquired automatic cooking information; selecting a cooking item to be changed among the displayed cooking items; and changing the selected cooking item.

In accordance with yet another aspect of the invention, there is a control method of a cooking system which cooks food using automatic cooking information, the cooking system including an external terminal and a cooking apparatus, the control method including: acquiring the automatic cooking information using the external terminal; providing the acquired automatic cooking information to the cooking apparatus; allowing the cooking apparatus to change the provided automatic cooking information; and cooking food on the basis of the changed cooking information.

The external terminal may retrieve data stored in a memory of the cooking apparatus or a web-server database, and acquire the automatic cooking information.

The external terminal may provide the acquired automatic cooking information to the cooking apparatus via wired or wireless communication.

In accordance with yet another aspect of the invention, there is a control method of a cooking system which cooks food using automatic cooking information, the cooking system including an external terminal and a cooking apparatus, the control method including: acquiring the automatic cooking information using the external terminal; allowing the external terminal to change the corresponding automatic cooking information; providing the changed automatic cooking information to the cooking apparatus; and cooking food on the basis of the changed cooking information.

The external terminal may retrieve data stored in a memory of the cooking apparatus or a web-server database, and acquire the automatic cooking information.

The external terminal may provide the acquired automatic cooking information to the cooking apparatus via wired or wireless communication.

The external terminal may output the acquired automatic cooking information of a bar code type, and provide the outputted automatic cooking information to the cooking apparatus.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
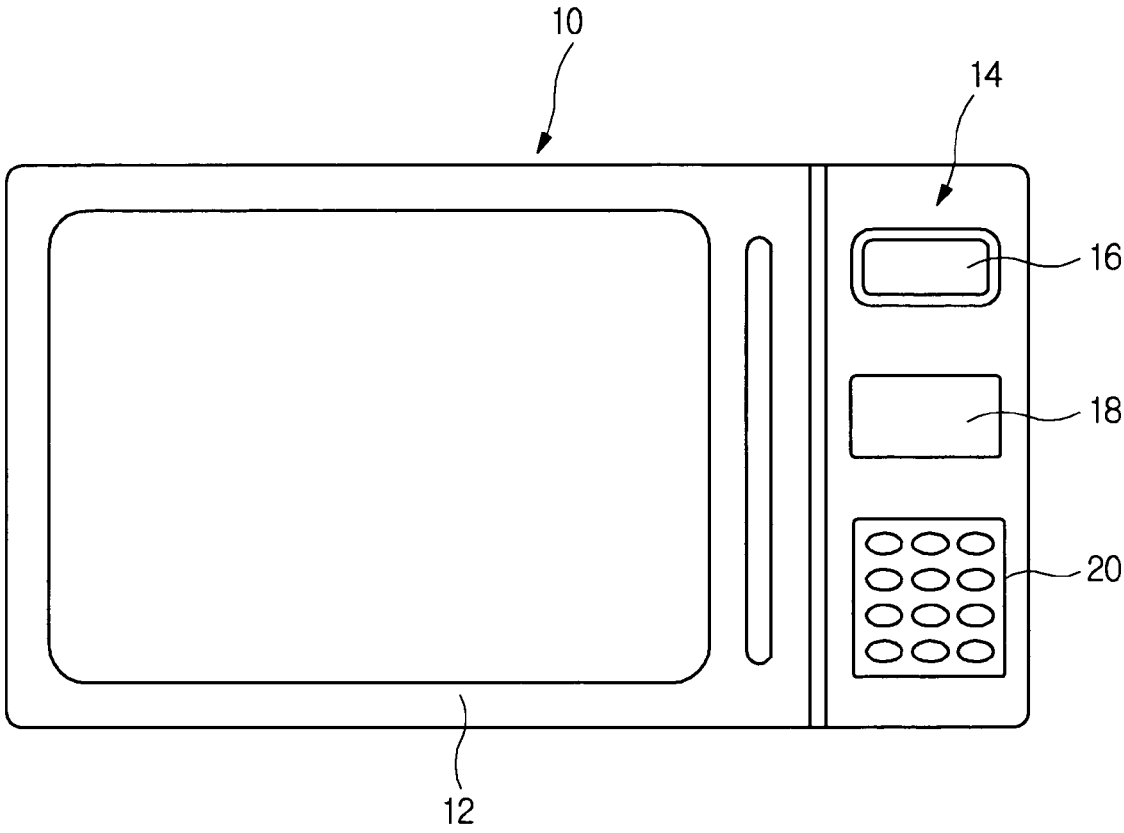
FIG. 1 is a view showing the shape of a cooking apparatus according to the invention.

Reference will now be made in detail to the embodiments of the invention, examples of which are illustrated in the accompanying drawings, where like reference numerals refer to the like elements throughout. The embodiments are described below to explain the invention by referring to the figures.

FIG. 1 is a view showing the shape of a cooking apparatus according to the invention.

As shown in this drawing, the cooking apparatus according to the invention includes a body 10, a door 12 arranged at the front side of the body 10, and a front panel 14 arranged at the right side of the door 12.

In addition, the cooking apparatus includes an embedded type bar code reader 16 for scanning a bar code attached to a packing paper for food at the upper side of the front panel 14, a display unit 18 for displaying operating states of the cooking apparatus at the bottom side of the bar code reader 16, and an input unit 20 having a plurality of input buttons at the bottom side of the display unit 18.

Figure 2:
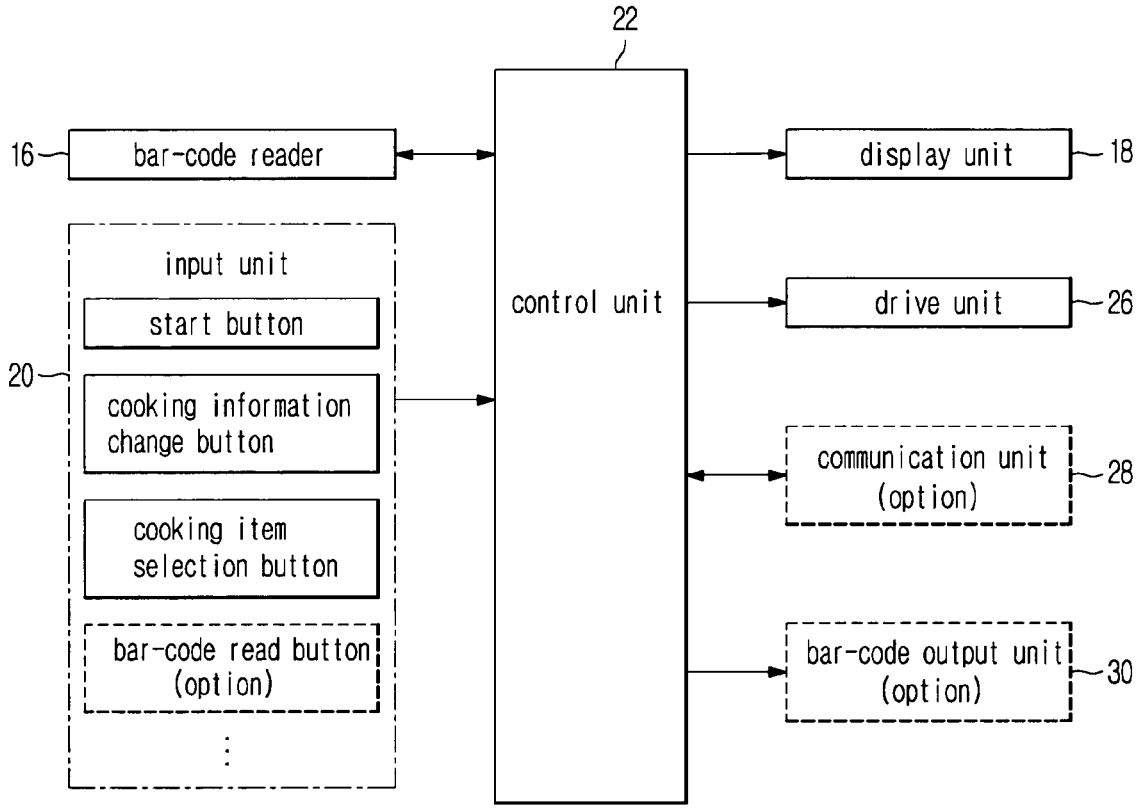
FIG. 2 is a block diagram showing the configuration of a cooking apparatus according to a first embodiment of the invention.

FIG. 2 is a block diagram showing the configuration of a cooking apparatus according to a first embodiment of the invention.

As shown in this drawing, the cooking apparatus according to the first embodiment of the invention includes a bar code reader 16, a display unit 18 for displaying operating states of the cooking apparatus, an input unit 20 for allowing a user to input control commands, a control unit 22, a driving unit 26, a communication unit 28 and a bar code output unit 30.

The bar code reader 16 is designed to scan a bar code to read cooking information, where the bar code in which a manufacturer presets cooking information is attached to a food package.

The input unit 20 includes a plurality buttons such as a start button, a cooking information change button, a cooking item selection button or the like. The start button allows a user to input a cooking start signal. The cooking information change button allows the user to change a cooking item of the cooking information. The cooking item selection button allows the user to select cooking items such as cooking time, a power level, etc., and to change into desired values. In addition, the input unit 20 may selectively include a bar code read button as needed, wherein the bar code read button allows the user to input a bar code read signal so that the bar code reader 16 can be manually operated.

Meanwhile, the cooking apparatus may include a bar code reader 16 for automatically scanning the bar code when a user brings the bar code near to the cooking apparatus. In this case, the cooking apparatus may not include the bar code read button of the input unit 20.

The control unit 22 is a microcontroller for controlling overall operations of the cooking apparatus. When cooking food using the cooking information, the control unit 22 may include a mode for allowing the user to change the cooking item of the cooking information. According to the mode, the control unit 22 determines whether a cooking information change signal is inputted for changing some cooking items among the overall cooking items of the cooking information (cooking time, cooking temperature, a power level and other information). If the cooking information change signal is not inputted, the control unit 22 controls cooking operations according to the pre-acquired cooking information, and if the cooking information change signal is inputted, the control unit 22 controls cooking operations according to the changed cooking information based on the preferences of the user or the amount of food.

The driving unit 26 drives a magnetron (not shown) or an electrical heater (not shown) based on a control signal of the control unit 22 so as to cook food.

The communication unit 28 is designed to receive automatic cooking information from an external apparatus through power line communication or wired/wireless communication, wherein the automatic cooking information includes cooking information set by the user. Using power line, LAN, Bluetooth, infrared communication, etc., the communication unit 28 communicates with an external terminal (a personal PC, a refrigerator with a web pad, a wireless telephone or the like) which is capable of accessing other cooking apparatus, a website of food manufacture, or a cooking website (for example, www.menupan.com). The cooking apparatus according to the first embodiment of the invention may selectively include the communication unit 28 as needed.

That is, the cooking apparatus requires the communication unit 28 in following cases: in the case where the cooking apparatus changes the cooking information when the cooking information acquired from the external terminal is transmitted to the cooking apparatus through the communication unit 28, or in the case where the external terminal transmits the changed cooking information to the cooking apparatus through the communication unit 28 after the external terminal acquires and changes the cooking information.

On the other hand, in the case where the cooking apparatus directly acquires the cooking information using a bar code or the like, the cooking apparatus may not require the additional communication unit 28. Similarly, when a cooking system changes cooking information acquired from the external terminal into a bar code, and outputs the bar code, the cooking apparatus may not require the additional communication unit 28 in the case where the cooking apparatus scans the bar code. The cooking system will subsequently be described in detail.

The bar code output unit 30 is designed to output the cooking information of the bar code type, wherein the cooking information is changed in the body 10 of the cooking apparatus according to the control signal of the control unit 22. The cooking apparatus may selectively include the bar code output unit 30 as needed.

Figure 3:
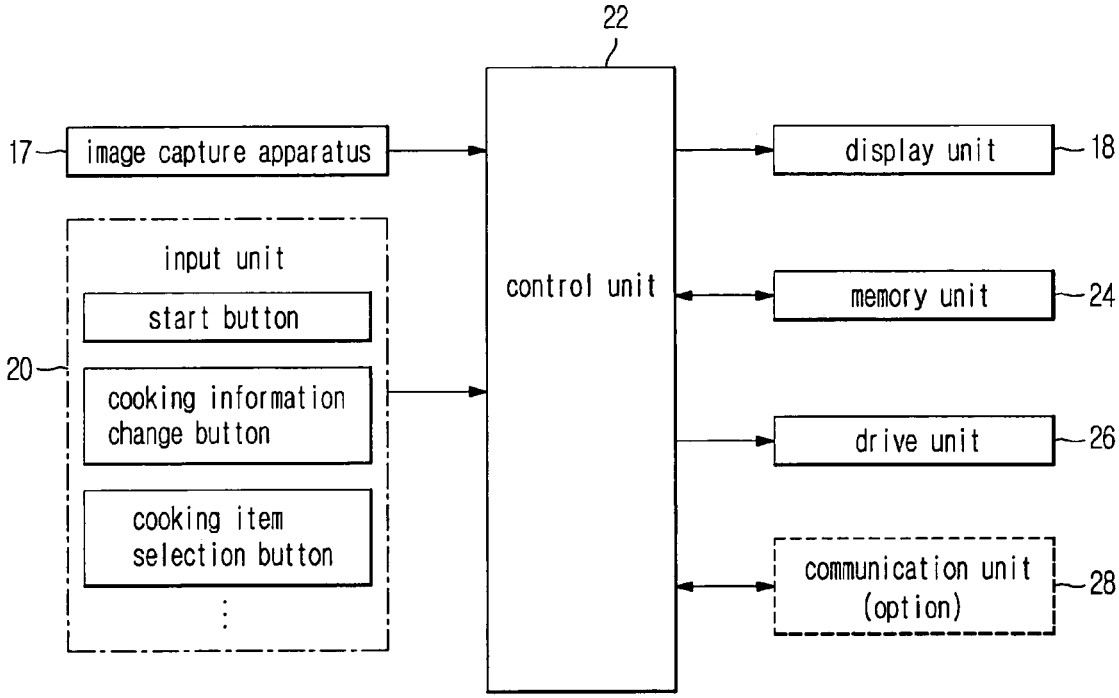
FIG. 3 is a block diagram showing the configuration of a cooking apparatus according to a second embodiment of the invention.

FIG. 3 is a block diagram showing the configuration of a cooking apparatus according to a second embodiment of the invention.

As shown in this drawing, the cooking apparatus according to the second embodiment of the invention includes an image capture apparatus 17, a display unit 18, an input unit 20, a control unit 22, a memory 24, a driving unit 26 and a communication unit 28. In the following description of the second embodiment of the invention, because the same or similar elements as those of the first embodiment as shown in FIG. 2 are denoted by the same reference numerals, a detailed description will be omitted.

The image capture apparatus 17 is a camera for capturing a printed image on the food package. The memory 24 stores image data of the respective food and cooking information in relation to the corresponding food. The control unit 22 compares the captured food image with the image stored in the memory 24, identifies a food identification number (ID) according to the compared result, and acquires automatic cooking information corresponding to the identified food ID. Thus, the control unit 22 controls cooking operations based on the changed cooking information suitable to the preference of the user or the amount of food.

Now, a control method using the above cooking apparatus will be explained.

Figure 4:
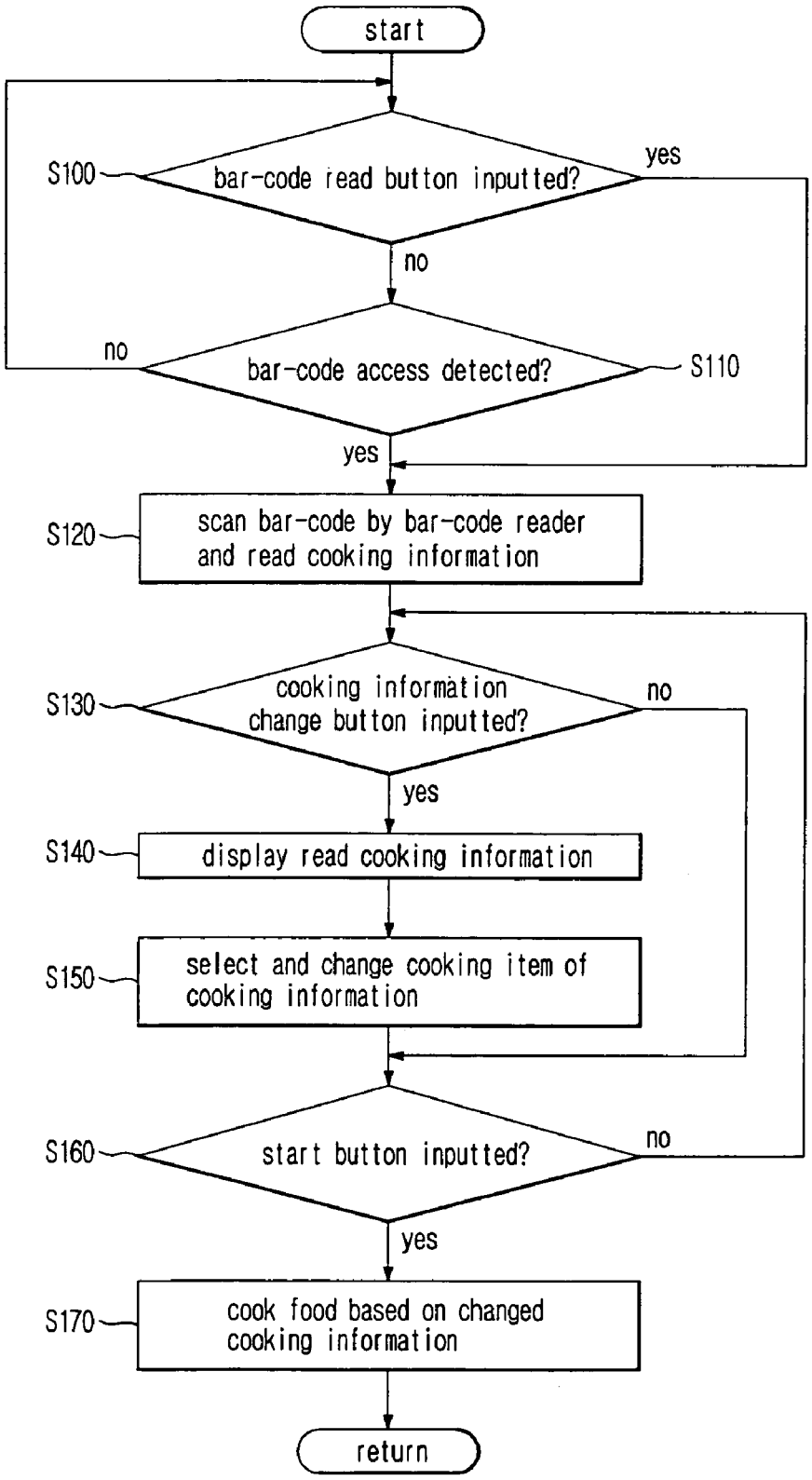
FIG. 4 is a flowchart illustrating a control method for changing cooking information using a cooking apparatus according to the invention.

FIG. 4 is a flowchart illustrating a control method for changing cooking information using a cooking apparatus according to the invention.

To begin with, the control unit 22 determines whether a bar code read signal is inputted through the bar code read button arranged in the input unit 20 (S100). If the control unit 22 does not receive the bar code read signal, the control unit 22 automatically detects an accessing of the bar code (S110). In the case where the access of the bar code is detected through an additional bar code position sensor or the control unit 22, the bar code reader 16 is automatically operated by the access of the bar code and scans the bar code.

Thus, when the bar code read signal is inputted by manually pushing the bar code read button or when the access of the bar code is automatically detected, the control unit 22 transmits a control signal to the bar code reader 16 to prepare scanning of the bar code. In this bar code scan preparation state, when the user accesses the bar code attached to the packing paper of food to the bar code reader 16, the bar code reader 16 scans the bar code and reads the cooking information (S120).

Herein, in order to determine whether the cooking apparatus cooks food according to the cooking information acquired from the bar code or according to the changed cooking information suitable to preference of the user or the amount of the food, the control unit 22 determines whether the cooking information change signal is inputted through the cooking information change button arranged in the input unit 20 (S130).

When the cooking information change signal is inputted, the display unit 18 displays the cooking information acquired from the bar code under control of the control unit 22 (S140).

The cooking information displayed through the display unit 18 is the cooking information previously acquired through the bar code reader 16. The user may push the cooking information change button and override the start button so as to select the desired cooking item.

Thus, the user can select some desired items among the total cooking items (cooking time, cooking temperature, a power level, etc.) of the cooking information displayed through the display unit 18, and can change the cooking items (S150).

For example, in the case of cooking instant rice, when the user desires well-done rice cooked to their liking, if the acquired cooking information through the bar code is preset to 5 minutes cooking time and 80% power level, the user can change the cooking time and power level to 6 minutes and 85%, respectively.

Next, the control unit 22 determines whether a cooking start signal is inputted through the start button (S160). If the cooking start signal is inputted, the control unit 22 controls a drive of the magnetron according to the changed cooking information, thereby performing cooking based on the user's preferences.

Referring to FIG. 4, the cooking apparatus according to the invention can change the cooking information to that suitable to the user's preferences through the input unit 20 arranged in the body 10, and output the changed cooking information of the bar code type through an additional bar code output unit 30.

On the other hand, if the cooking apparatus according to the invention can not acquire the cooking information from the bar code, it directly takes the image printed on the food package using the image capture apparatus as shown in FIG. 3, compares the captured image with the image stored in the memory 24, and acquires the resulting cooking information. Thus, the cooking apparatus can immediately change the acquired cooking information into the cooking information that is suitable to the user's preferences, and can output the changed cooking information of the bar code type through the bar code output unit 30.

In addition, the cooking apparatus according to the invention can receive the cooking information changed by the user through the external terminal, where, as methods for receiving the cooking information through the external terminal, the cooking apparatus can directly receive the cooking information through a wired/wireless communication, or can acquire the cooking information through the bar code generated based on the changed cooking information.

In addition, if the external terminal acquires and transmits the cooking information through the bar code reader, website, screen image or the like, the cooking apparatus according to the invention can change the transmitted cooking information. In addition, if the external terminal acquires the cooking information through the bar code reader, website, screen image or the like, changes the cooking information, and transmits the changed cooking information to the cooking apparatus, the cooking apparatus according to the invention can acquire the transmitted cooking information.

Hereinafter, a method for receiving the cooking information through the wired/wireless communication will be explained.

Figure 5:
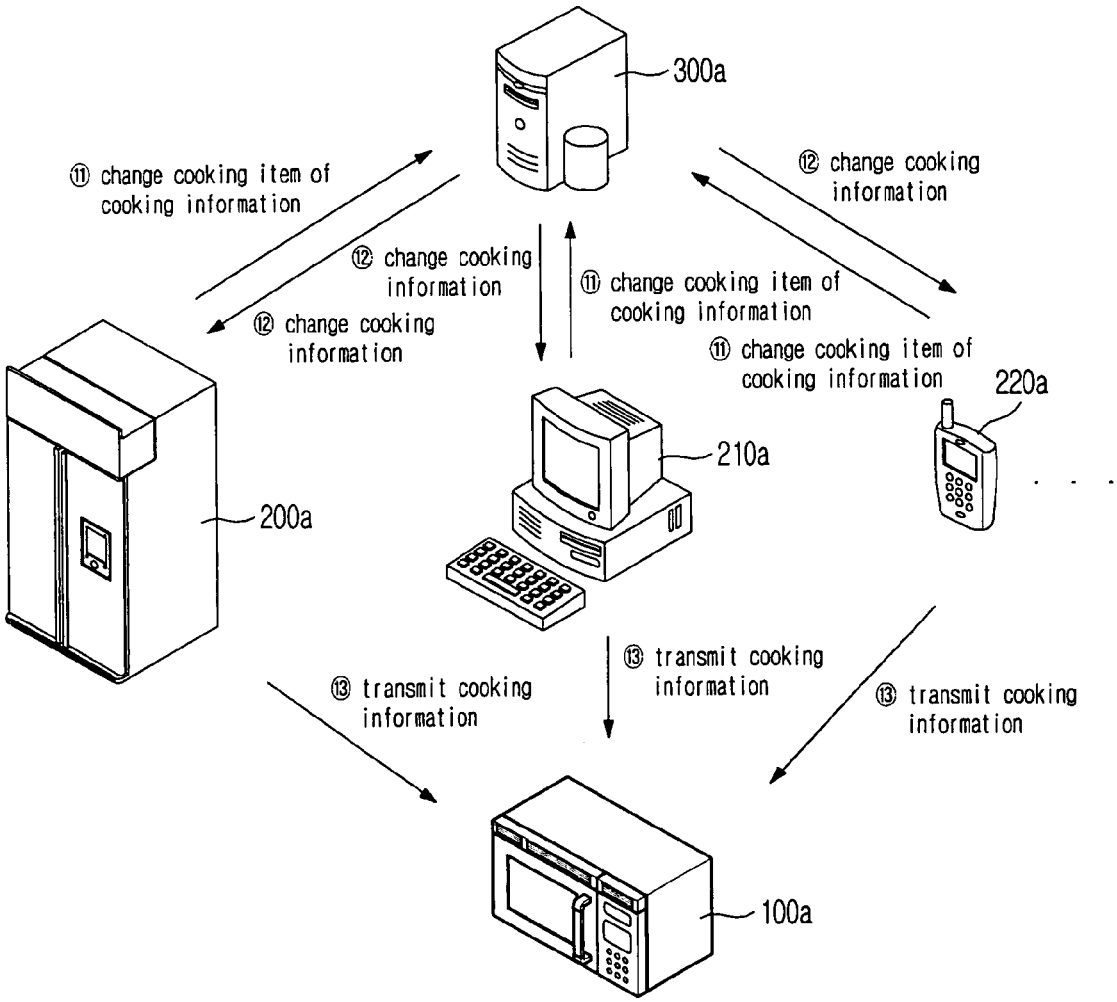
FIG. 5 is a diagram showing the configuration of a system for transmitting changed cooking information to a cooking apparatus using external terminals.

FIG. 5 is a diagram showing the configuration of a system for transmitting changed cooking information to a cooking apparatus using external terminals.

As shown in this drawing, the cooking system according to the invention includes a cooking apparatus 100*a*, terminals 200*a*, 210*a* and 220*a*, and a web server 300*a*.

In the case where the cooking system according to the invention accesses the website through the terminals 200*a*, 210*a* and 220*a*, all operations with respect to a change of the cooking information may be performed via the web server 300*a*. In addition, the cooking system according to the invention may include the terminals 200*a*, 210*a* and 220*a*, which can embed a client program for directly changing and correcting the cooking information of the bar code type.

The cooking apparatus 100*a* includes the configuration of the cooking apparatus as shown in FIG. 1 and FIG. 2, and further includes the communication unit 28 which receives the cooking information from the terminals 200*a*, 210*a* and 220*a* through the wired/wireless communication.

The terminals 200*a*, 210*a* and 220*a* are external terminals which are capable of accessing a website hosted by the web server 300*a*. The terminals 200*a*, 210*a* and 220*a* may include PC, web pad of the refrigerator, PDA, wireless telephone or any other apparatuses in which websites can be transmitted.

In addition, in the case where the client program for directly correcting the cooking information of the bar code type is embedded in the terminals 200*a*, 210*a* and 220*a*, when the cooking items of the cooking information (cooking time, cooking temperature, power level and other information) that are suitable to the user's preferences are changed, the terminals 200*a*, 210*a* and 220*a* may correct the cooking information according to the changed cooking items of the cooking information, and may transmit the corrected cooking information to the cooking apparatus 100 through the wired or wireless communication module.

According to another modified example, the cooking information may be changed in the web server 300*a*. That is, the web server 300*a* provides all cooking information (cooking time, cooking temperature, power level and other information) with respect to food through various sources such as the cooking apparatus 100*a*, the website of food manufacture, or a cooking website, etc. When the cooking items of the cooking information (cooking time, cooking temperature, power level and other information) that are suitable to the preferences of the user are changed using the terminals 200*a*, 210*a* and 220*a*, the cooking information is changed in the web server 300*a*. Accordingly, the web server 300*a* transmits the changed cooking information to the terminals 200*a*, 210*a* and 220*a*, and the terminals 200*a*, 210*a* and 220*a* transmits the changed cooking information to the cooking apparatus 100*a*.

Figure 6:
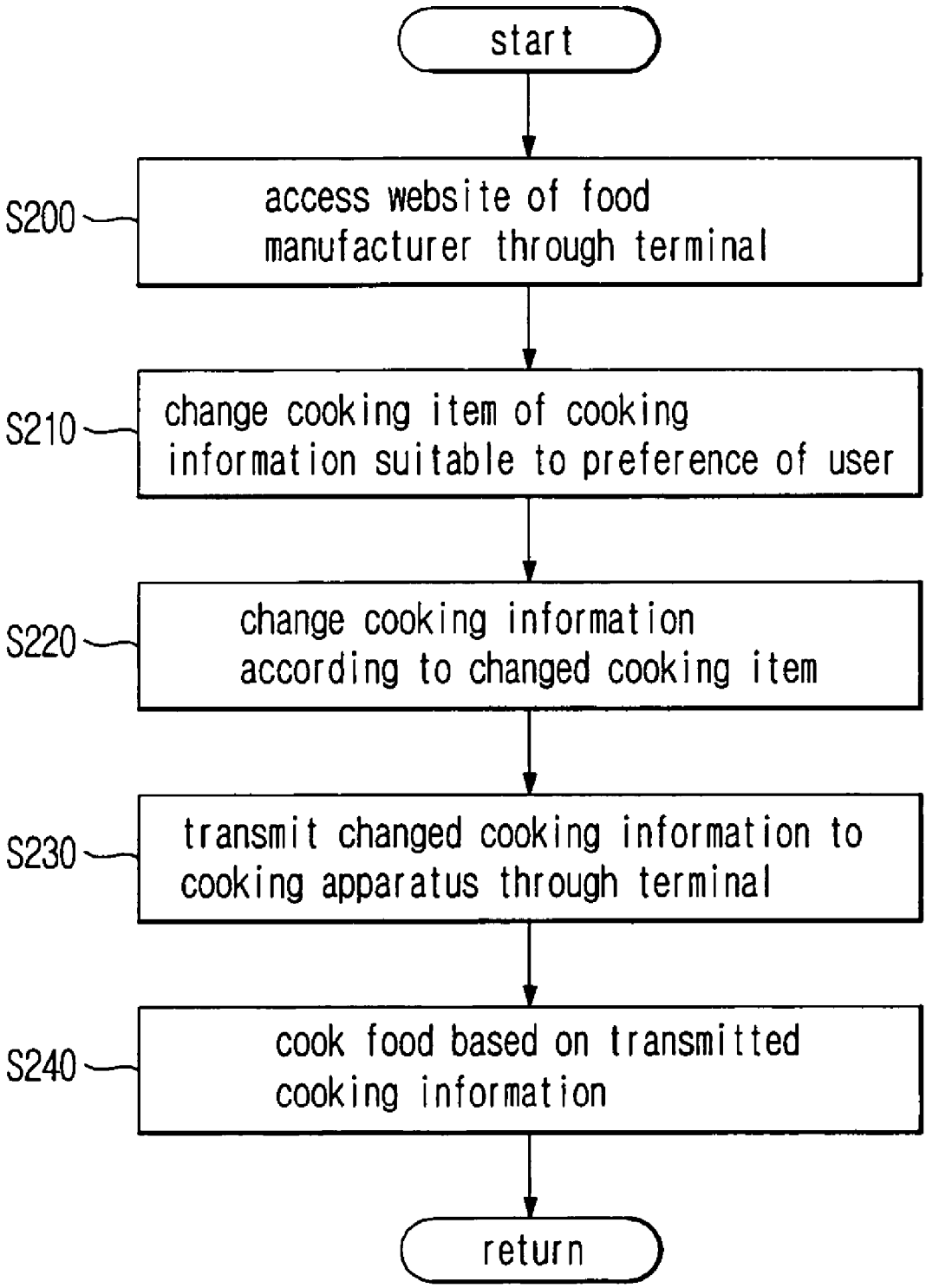
FIG. 6 is a flowchart illustrating a control method in FIG. 5.

FIG. 6 is a flowchart illustrating a control method in FIG. 5.

Referring to FIG. 6, to begin with, the user accesses the website hosted by the web server 300*a* through the terminals 200*a*, 210*a* and 220*a* (S200).

Next, when the user selects and changes the cooking items of the cooking information that are suitable to the preferences of the user as shown in 11 of FIG. 5 using the terminals 200*a*, 210*a* and 220*a*, the changed cooking items of the cooking information are transmitted to the web server 300*a* (S210).

Thus, the web server 300*a* analyses the cooking items of the cooking information changed using the terminals 200*a*, 210*a* and 220*a*, changes the cooking information desired by the user, and, as shown in 12 of FIG. 5, transmits the changed cooking information to the terminals 200*a*, 210*a* and 220*a* (S220). The terminals 200*a*, 210*a* and 220*a* receives the changed cooking information, and, as shown in 13 of FIG. 5, transmits the changed cooking information to the cooking apparatus 100*a* (S230).

Subsequently, the cooking apparatus 100*a* receives the cooking information transmitted from the terminals 200*a*, 210*a* and 220*a*, through the communication unit 28, and drives the magnetron to cook food (S240).

In addition, in the case where the client program for directly correcting the cooking information of the bar code type is embedded in the terminals 200*a*, 210*a* and 220*a*, when the cooking items of the cooking information (cooking time, cooking temperature, power level and other information) that are suitable to preference of the user's preferences are changed, the terminals 200*a*, 210*a* and 220*a* may correct the cooking information according to the changed cooking items of the cooking information, and may transmit the corrected cooking information to the cooking apparatus 100*a*.

Hereinafter, a method for creating a bar code according to the cooking information changed by the user, and printing the bar code will be explained.

Figure 7:
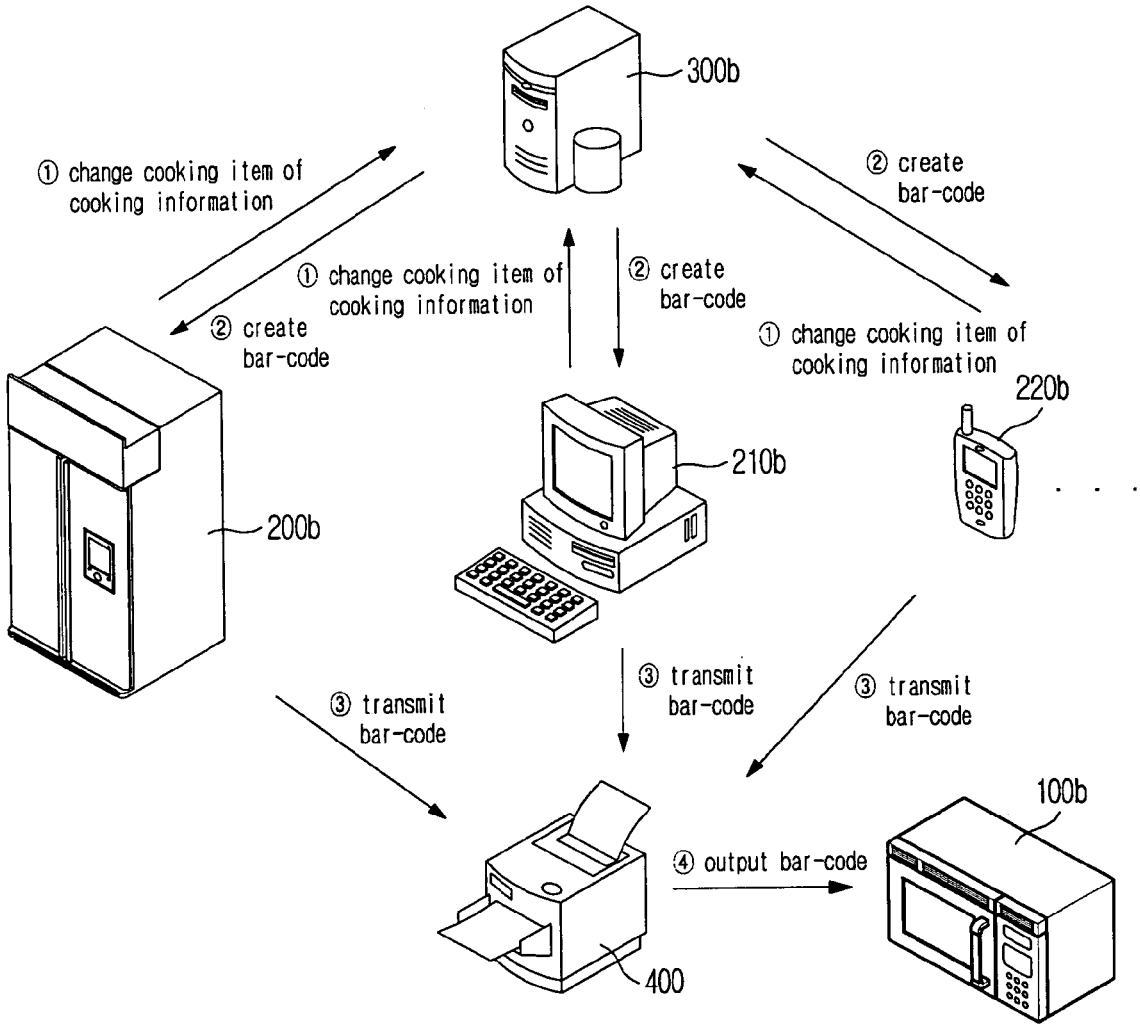
FIG. 7 is a diagram showing the configuration of a system for creating a bar code of changed cooking information using external terminals.

FIG. 7 is a diagram showing the configuration of a system for creating a bar code of changed cooking information using external terminals.

As shown in this drawing, the cooking system includes a cooking apparatus 100*b*, terminals 200*b*, 210*b* and 220*b*, a web server 300*b* and an output unit 400.

In the case where the cooking system according to the invention accesses the website through the terminals 200*b*, 210*b* and 220*b*, all operations with respect to a change of the cooking information may be performed in the web server 300*b*. In addition, the cooking system according to the invention may include the terminals 200*b*, 210*b* and 220*b*, which can embed a client program for directly correcting the cooking information of the bar code type.

The cooking apparatus 100*b* according to the embodiment of the invention includes the configuration of the cooking apparatus as shown in FIG. 1 and FIG. 2. In the case where the external terminals 200*b*, 210*b* and 220*b* transmits the cooking information of the bar code type, since the cooking apparatus 100*b* acquires the cooking information through the bar code reader 16 in the cooking apparatus 100*b*, the cooking apparatus 100*b* may not include the above communication unit 28.

The terminals 200*b*, 210*b* and 220*b* are external terminals that are capable of accessing a website hosted by the web server 300*b*. The terminals 200*b*, 210*b* and 220*b* may include a PC, a web pad of the refrigerator, a PDA, a wireless telephone or any other apparatuses that are capable of accessing websites.

In addition, in the case where the client program for directly correcting the cooking information of the bar code type is embedded in the external terminals 200*b*, 210*b* and 220*b*, when the cooking items of the cooking information (cooking time, cooking temperature, power level and other information) that are based on the preferences of the user are changed, the external terminals 200*b*, 210*b* and 220*b* correct the cooking information according to the changed cooking items of the cooking information, and convert the corrected cooking information into the cooking information of the bar code type. Accordingly, when the external terminals 200*b*, 210*b* and 220*b* transmit the converted cooking information of the bar code type to the output unit 400, the output unit 400 prints the cooking information of the bar code type.

Similarly to the above example, the cooking information may be changed in the web server 300*b*. That is, the web server 300*b* provides all cooking information (cooking time, cooking temperature, power level and other information) with respect to food through various sources such as the cooking apparatus 100*b*, the website of a food manufacturer, or a cooking website, etc. When the cooking items of the cooking information (cooking time, cooking temperature, power level and other information) that which are suitable to the preferences of the user are changed using the terminals 200*b*, 210*b* and 220*b*, the cooking information is changed in the web server 300*b*. Accordingly, the web server 300*b* corrects the cooking information according to the changed cooking items of the cooking information, and converts the corrected cooking information into the cooking information of the bar code type. The web server 300*b* transmits the converted cooking information of the bar code type to the external terminals 200*b*, 210*b* and 220*b*, and the external terminals 200*b*, 210*b* and 220*b* transmit the converted cooking information of the bar code type to the output unit 400. Accordingly, the output unit 400 prints the cooking information of the bar code type.

Herein, the output unit 400 is a printing apparatus such as a printer, etc., for outputting the bar code transmitted from the external terminals 200*b*, 210*b* and 220*b*.

Figure 8:
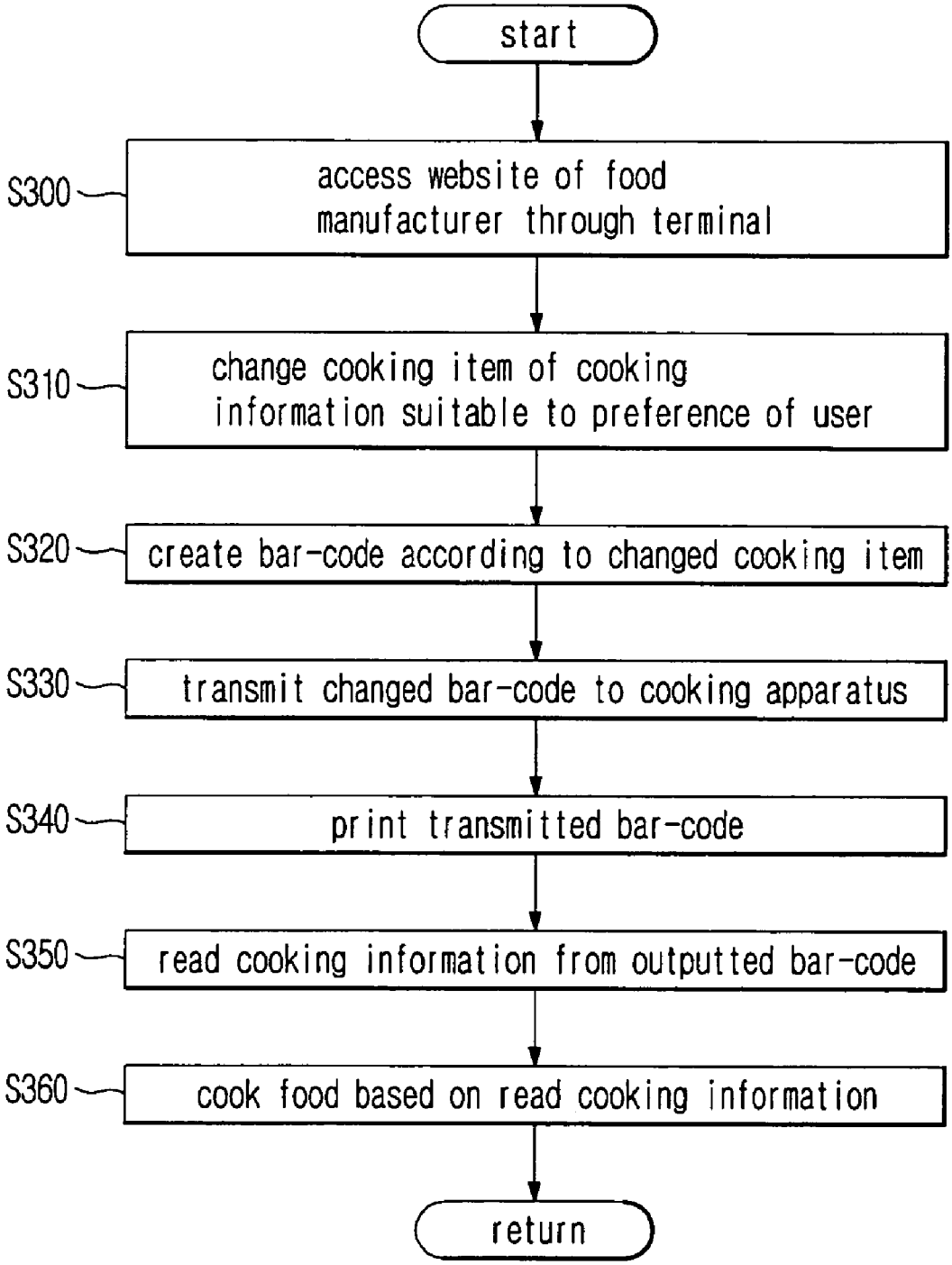
FIG. 8 is a flowchart illustrating a control method in FIG. 7.

FIG. 8 is a flowchart illustrating a control method in FIG. 7.

Referring to FIG. 8, to begin with, the user accesses the website hosted by the web server 300*b* through the terminals 200*b*, 210*b* and 220*b* (S300).

Next, when the user selects and changes the cooking items of the cooking information suitable to the preferences of the user as shown in 1 of FIG. 7 using the terminals 200*b*, 210*b* and 220*b*, the changed cooking items of the cooking information are transmitted to the web server 300*b* (S310).

Thus, the web server 300*b* analyzes the cooking items of the cooking information that were changed by the user using the terminals 200*b*, 210*b* and 220*b*, creates the cooking information of the bar code type, and, as shown in 2 of FIG. 7, transmits the new cooking information of the bar code type to the external terminals 200*b*, 210*b* and 220*b* (S320, S330). The terminals 200*b*, 210*b* and 220*b* receive the new cooking information of the bar code type, and transmit the new cooking information of the bar code type to the output unit 400, as shown in 3 of FIG. 7. Accordingly, the output unit 400 prints the cooking information of the bar code type (S340).

In addition, the cooking apparatus 100*b* scans the bar code printed from the output unit 400 using the bar code reader 16, decodes the bar code, and acquires the cooking information of the bar code type according to the decoded bar code (S350).

Meanwhile, in the case of a wireless telephone or a portable web-pad, the bar code is outputted on the display unit of the wireless telephone or the portable web-pad. The bar code reader 16 of the cooking apparatus 100*b* may scan the displayed bar code, decode the bar code, and acquire the cooking information of the bar code type according to the decoded bar code.

Subsequently, the cooking apparatus 100*b* drives the magnetron to cook food according to the acquired cooking information (S360).

On the other hand, in the case where the cooking system according to the invention can acquire the cooking information from the bar code, the cooking system directly takes the image printed on the packing paper of food using the image capture apparatus 17, compares the captured food image with the image stored in the memory 24, and acquires the cooking information. The cooking system can immediately change the acquired cooking information into the cooking information suitable to the preferences of the user, convert the changed cooking information into the cooking information of the bar code type, and output the cooking information of the bar code type through the bar code output unit 30.

Meanwhile, in the embodiment of the invention, in the case where the user changes the cooking information that is suitable to the preferences of the user or the amount of the food, the cooking information may be changed through the input unit 20 arranged in the cooking apparatuses 100*a* and 100*b* or the cooking information may be changed using the external terminals 200*a*, 210*a*, 220*a*, 210*b*, 210*b* and 220*b*. However, the invention is not limited thereto, and may change the cooking information by directly connecting the cooking apparatuses 100*a*, 100*b* to the web server 300*a* and 300*b*.

As is apparent from the above description, the invention provides a cooking apparatus, cooking system and control method using the same, wherein, by arranging a mode in which a user can change cooking information acquired through a bar code, when cooking food using automatic cooking information, the user can change the cooking information that is suitable to the preferences of the user or the amount of the food, thereby increasing user satisfaction.

In addition, the invention provides a cooking apparatus, cooking system and control method using the same, where, it is possible to output changed cooking information to the cooking apparatus or to output the cooking information of the bar code type, using a terminal capable of accessing a website of a food manufacturer or cooking websites.

Although a few embodiments of the invention have been shown and described, it would be appreciated by those skilled in the art that changes may be made in these embodiments without departing from the principles and spirit of the invention, the scope of which is defined in the claims and their equivalents.

What is claimed is:

1. An apparatus for cooking food using automatic cooking information, the apparatus comprising:

an automatic cooking information acquisition unit acquiring the automatic cooking information;

an automatic cooking information change unit for allowing a user to change the acquired automatic cooking information; and a control unit controlling a series of cooking operations on the basis of the changed cooking information, wherein the automatic cooking information acquisition unit comprises:

a camera capturing an image of the food; and a memory storing a plurality of food images and cooking information for corresponding foods, wherein the automatic cooking information acquisition unit compares the captured food image with the food images stored in the memory, determines an identification number (ID) of the food, and acquires the automatic cooking information corresponding to the ID of the food.

2. The apparatus as set forth in claim 1, further comprising a display unit displaying the acquired automatic cooking information, wherein the automatic cooking information change unit further comprises a button selecting the desired cooking item among cooking items displayed on the display unit.

3. A system for cooking food using automatic cooking information, the system comprising:

an external terminal acquiring automatic cooking information and transmitting the automatic cooking information to a cooking apparatus;

an automatic cooking information change unit allowing a user to change the transmitted automatic cooking information; and a cooking apparatus including a control unit controlling a series of cooking operations on the basis of the changed cooking information, wherein the external terminal comprises:

a camera capturing an image of the food; and a memory storing a plurality of food images and cooking information for corresponding foods, wherein the automatic cooking information acquisition unit compares the captured food image with the food images stored in the memory, determines an identification number (ID) of the food, and acquires the automatic cooking information corresponding to the ID of the food.

4. The system as set forth in claim 3, wherein the external terminal is any one of a PC, a PDA, a web pad and a wireless telephone, and the external terminal accesses a website/internet and acquires the automatic cooking information.

5. The system as set forth in claim 3, wherein the external terminal and the cooking apparatus further comprise a communication module transmitting the automatic cooking information via wired or wireless communication.

* * * * *